US008770689B2

(12) United States Patent
Igarashi

(10) Patent No.: US 8,770,689 B2
(45) Date of Patent: Jul. 8, 2014

(54) IMAGE FORMING APPARATUS INCLUDING RECORDING HEAD FOR EJECTING DROPLETS

(71) Applicant: Masanori Igarashi, Kanagawa (JP)

(72) Inventor: Masanori Igarashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/900,699

(22) Filed: May 23, 2013

(65) Prior Publication Data

US 2013/0321501 A1 Dec. 5, 2013

(30) Foreign Application Priority Data

May 31, 2012 (JP) ..... 2012-123989

(51) Int. Cl.
*B41J 2/195* (2006.01)
*B41J 2/175* (2006.01)

(52) U.S. Cl.
CPC *B41J 2/195* (2013.01); *B41J 2/175* (2013.01); *B41J 2/17513* (2013.01); *B41J 2/17566* (2013.01)
USPC ..... 347/7; 347/85

(58) Field of Classification Search
CPC .... B41J 2/17566; B41J 2/17513; B41J 2/175; B41J 2/195
USPC ..... 347/7, 19, 84, 85, 89
See application file for complete search history.

(56) References Cited

U.S. PATENT DOCUMENTS 8,366,257 B2 * 2/2013 Sasaki et al. ..... 347/89
8,540,352 B2 * 9/2013 Igarashi ..... 347/85
8,596,736 B2 * 12/2013 Kobayashi et al. ..... 347/7
2007/0109362 A1 5/2007 Hori et al.
2010/0231622 A1 9/2010 Sasaki et al.
2011/0057998 A1 3/2011 Igarashi
2011/0221801 A1 9/2011 Igarashi
2012/0007903 A1 1/2012 Igarashi
2012/0306950 A1 12/2012 Kobayashi et al.

FOREIGN PATENT DOCUMENTS

JP 2005-059490 3/2005
JP 2007-223230 9/2007
JP 2010-155446 7/2010
JP 2011-051294 3/2011
JP 2011-183729 9/2011
JP 2011-207206 10/2011

OTHER PUBLICATIONS

U.S. Appl. No. 13/813,835, filed Jul. 25, 2011.

* cited by examiner

*Primary Examiner* — An Do
(74) *Attorney, Agent, or Firm* — Cooper & Dunham LLP

(57) ABSTRACT

An image forming apparatus includes a recording head, a head tank, a main tank, a liquid feed device, a measurement unit, and a supply controller. The head tank includes a liquid storage portion, a liquid level detection member, and an air release unit. When the feed device feeds liquid from the main tank to the head tank with an interior of the storage portion opened relative to an atmosphere and the detection member does not detect a liquid level of the liquid after a threshold time, the supply controller controls the air release unit to close the interior of the storage portion and determines whether a measurement value of a consumption amount of the liquid is a threshold value or lower. When the measurement value is the threshold value or lower, the supply controller performs a reverse feed control to drive the feed device to feed the liquid in reverse.

5 Claims, 12 Drawing Sheets

IMAGE FORMING APPARATUS INCLUDING RECORDING HEAD FOR EJECTING DROPLETS

CROSS-REFERENCE TO RELATED APPLICATIONS

This patent application is based on and claims priority pursuant to 35 U.S.C. §119 to Japanese Patent Application No. 2012-123989, filed on May 31, 2012, in the Japan Patent Office, the entire disclosure of which is hereby incorporated by reference herein.

BACKGROUND

1. Technical Field

This disclosure relates to an image forming apparatus, and more specifically to an image forming apparatus including one or more recording heads for ejecting droplets.

2. Description of the Related Art

Image forming apparatuses are used as printers, facsimile machines, copiers, plotters, or multi-functional devices having two or more of the foregoing capabilities. As one type of image forming apparatus employing a liquid-ejection recording method, inkjet recording apparatuses are known that use one or more recording heads (liquid ejection head or droplet ejection head) for ejecting droplets of ink or other liquid.

Such a liquid-ejection type image forming apparatus may have a head tank (also referred to as sub tank or buffer tank) to supply liquid to a recording head and a liquid supply system to supply liquid to the head tank via a supply tube (supply passage) from a main tank (ink cartridge) removably (replaceably) mounted on an apparatus body.

For such a liquid supply system, if the liquid feed pump continues to be driven to feed liquid with the ink cartridge empty, the internal pressure of the ink cartridge and the supply passage becomes a negative pressure. When the ink cartridge is removed from the apparatus body for replacement, air intrudes into the supply passage. Such air is delivered as bubbles from the head tank to the recording head, thus causing ejection failure.

Hence, for example, an inkjet recording apparatus may have a reversible pump as the liquid feed pump. If the liquid feed pump feeds ink from the main tank to the head tank with the main tank being short of ink, the liquid feed pump feeds ink in reverse from the head tank to the main tank to prevent air from intruding into the supply passage (see JP-2011-051294-A and JP-2010-155446-A).

However, if the liquid feed pump is driven for reverse rotation to feed ink in reverse with the remaining amount of ink in the head tank being small, air may be inhaled into the supply passage. Hence, JP-2011-051294-A proposes an inkjet recording apparatus having a liquid level detection member to detect the height of the liquid level of ink in the head tank. Even in a case in which the liquid feed pump feeds ink from the main tank to the head tank with the main tank being short of ink, when the height of the liquid level of ink in the head tank is a threshold height or lower, in other words, the liquid level detection member does not the liquid level, the liquid feed pump does not perform reverse rotation feeding to prevent air from being inhaled from the head tank into the supply passage connected to the main tank.

However, the inventor has recognized that, for a configuration in which a supply port member of the supply passage is located at a position lower than the liquid level detection member in the head tank, if the liquid feed pump is controlled so as not to feed ink in reverse when the liquid level detector does not detect the liquid level as described in JP-2011-051294-A, a situation occurs in which the liquid feed pump does not feed ink in reverse in spite of being able to feed ink in reverse, thus resulting in an increased risk of air bubble intrusion on replacement of the main tank.

BRIEF SUMMARY

In an aspect of this disclosure, there is provided an image forming apparatus including a recording head, a head tank, a main tank, a liquid supply passage, a liquid feed device, a measurement unit, and a supply controller. The recording head ejects droplets of a liquid. The head tank is mounted on the recording head to supply the liquid to the recording head. The main tank is removably mounted in the image forming apparatus to store the liquid to be supplied to the recording head. The liquid supply passage connects the main tank to the head tank to supply the liquid from the main tank to the head tank. The liquid feed device feeds the liquid from the main tank to the head tank and in reverse from the head tank to the main tank. The measurement unit measures a consumption amount of the liquid discharged from the recording head. The supply controller drives the liquid feed device to control a liquid supply operation on the head tank. The head tank includes a tank housing, a liquid storage portion, a liquid level detection member, a liquid supply port member, and an air release unit. The liquid storage portion is disposed in the tank housing to store the liquid. The liquid level detection member detects a liquid level of the liquid in the liquid storage portion. The liquid supply port member is connected to the liquid feed device via the liquid supply passage. The liquid supply port member has an opening at a position lower than the liquid level detection member in the liquid storage portion. The air release unit opens and closes an interior of the liquid storage portion relative to an atmosphere. When the liquid feed device feeds the liquid from the main tank to the head tank with the interior of the liquid storage portion opened relative to the atmosphere by the air release unit and the liquid level detection member does not detect the liquid level of the liquid after an elapse of a threshold time, the supply controller controls the air release unit to close the interior of the liquid storage portion relative to the atmosphere and determines whether or not a measurement value of the consumption amount of the liquid measured by the measurement unit is a first threshold value or lower. When the measurement value is the first threshold value or lower, the supply controller performs a reverse feed control to drive the liquid feed device to feed the liquid in reverse from the head tank to the main tank.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
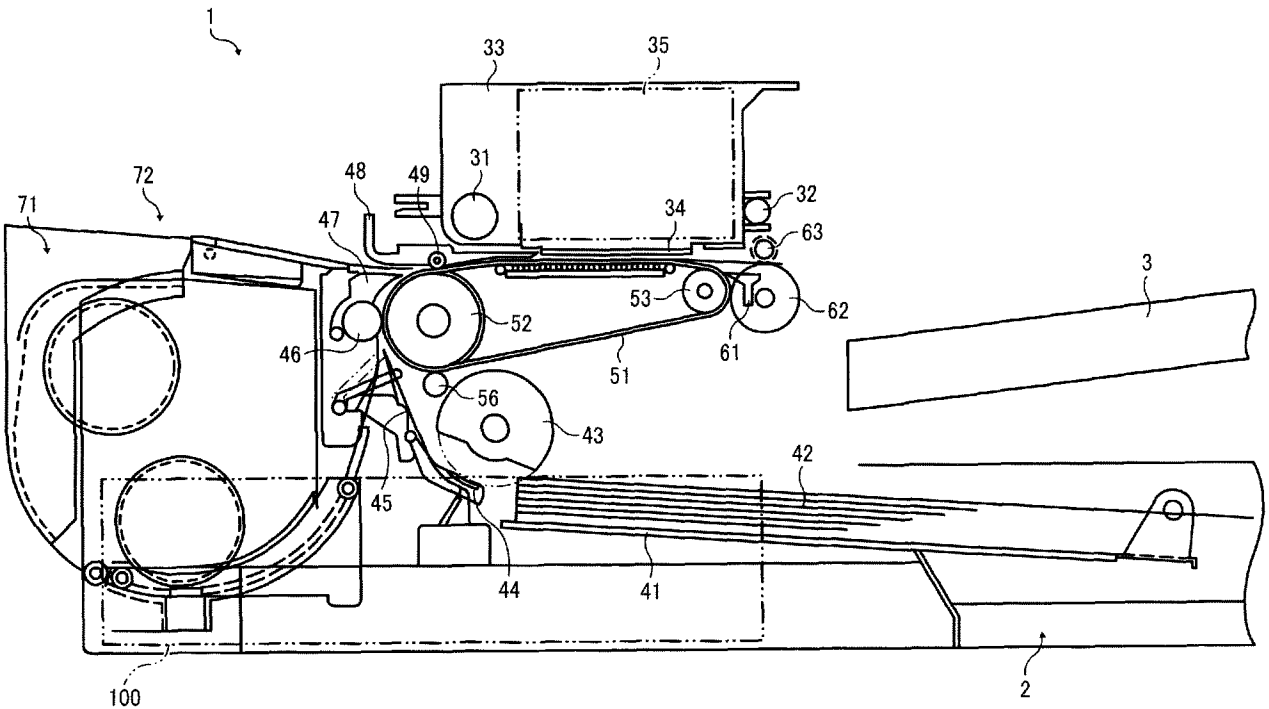
FIG. 1 is a schematic side view of a mechanical section of an image forming apparatus according to an exemplary embodiment of this disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

For example, in this disclosure, the term "sheet" used herein is not limited to a sheet of paper and includes anything such as OHP (overhead projector) sheet, cloth sheet, glass sheet, or substrate on which ink or other liquid droplets can be attached. In other words, the term "sheet" is used as a generic term including a recording medium, a recorded medium, a recording sheet, and a recording sheet of paper. The terms "image formation", "recording", "printing", "image recording" and "image printing" are used herein as synonyms for one another.

The term "image forming apparatus" refers to an apparatus that ejects liquid on a medium to form an image on the medium. The medium is made of, for example, paper, string, fiber, cloth, leather, metal, plastic, glass, wood, and ceramic. The term "image formation" includes providing not only meaningful images such as characters and figures but meaningless images such as patterns to the medium (in other words, the term "image formation" also includes only causing liquid droplets to land on the medium).

The term "ink" is not limited to "ink" in a narrow sense, unless specified, but is used as a generic term for any types of liquid usable as targets of image formation. For example, the term "ink" includes recording liquid, fixing solution, DNA sample, resist, pattern material, resin, and so on.

The term "image" used herein is not limited to a two-dimensional image and includes, for example, an image applied to a three dimensional object and a three dimensional object itself formed as a three-dimensionally molded image.

The term "image forming apparatus", unless specified, also includes both serial-type image forming apparatus and line-type image forming apparatus.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below.

First, an image forming apparatus according to an exemplary embodiment of this disclosure is described with reference to FIGS. 1 and 2.

FIG. 1 is a side view of an entire configuration of the image forming apparatus. FIG. 2 is a partial plan view of the image forming apparatus.

In this exemplary embodiment, the image forming apparatus is described as a serial-type inkjet recording apparatus. It is to be noted that the image forming apparatus is not limited to such a serial-type inkjet recording apparatus and may be any other type image forming apparatus. In the image forming apparatus, a carriage 33 is supported by a main guide rod 31 and a sub guide rod 32 so as to be slidable in a direction (main scanning direction) indicated by an arrow MSD in FIG. 2. The main guide rod 31 and the sub guide rod 32 serving as guide members extend between a left side plate 21A and a right side plate 21B of an apparatus body 1. The carriage 33 is reciprocally moved for scanning in the main scanning direction MSD by a main scanning motor via a timing belt.

The carriage 33 mounts recording heads 34*a* and 34*b* (collectively referred to as "recording heads 34" unless distinguished) serving as liquid ejection heads for ejecting ink droplets of different colors, e.g., yellow (Y), cyan (C), magenta (M), and black (K). The recording heads 34*a* and 34*b* are mounted on the carriage 33 so that nozzle rows, each of which includes multiple nozzles, are arranged in parallel to a direction (sub scanning direction) perpendicular to the main scanning direction and ink droplets are ejected downward from the nozzles.

Each of the recording heads 34 has two nozzle rows. For example, one of the nozzles rows of the recording head 34*a* ejects liquid droplets of black (K) and the other ejects liquid droplets of cyan (C). In addition, one of the nozzles rows of the recording head 34*b* ejects liquid droplets of magenta (M) and the other ejects liquid droplets of yellow (Y).

The carriage 33 mounts head tanks 35*a* and 35*b* (collectively referred to as "head tanks 35" unless distinguished) to supply the respective color inks to the corresponding nozzle rows. A supply pump unit 24 supplies (replenishes) the respective color inks from ink cartridges 10*y*, 10*m*, 10*c*, and 10*k* removably mountable in a cartridge mount portion 4 to the head tanks 35 via supply tubes 36 dedicated for the respective color inks.

The image forming apparatus further includes a sheet feed section to feed sheets 42 stacked on a sheet stack portion (platen) 41 of a sheet feed tray 2. The sheet feed section further includes a sheet feed roller 43 and a separation pad 44. The sheet feed roller 43 has a shape of, e.g., a substantially half moon to separate the sheets 42 from the sheet stack portion 41 and feed the sheets 42 sheet by sheet. The separation pad 44 made of a material of a high friction coefficient is disposed opposing the sheet feed roller 43 and urged toward the sheet feed roller 43.

To feed the sheet 42 from the sheet feed section to a position below the recording heads 34, the image forming apparatus includes a first guide member 45 to guide the sheet 42, a counter roller 46, a conveyance guide member 47, a pressing member 48 including a front-end pressing roller 49, and a conveyance belt 51 to adhere the sheet 42 thereon by static electricity and convey the sheet 42 to a position opposing the recording heads 34.

Figure 2:
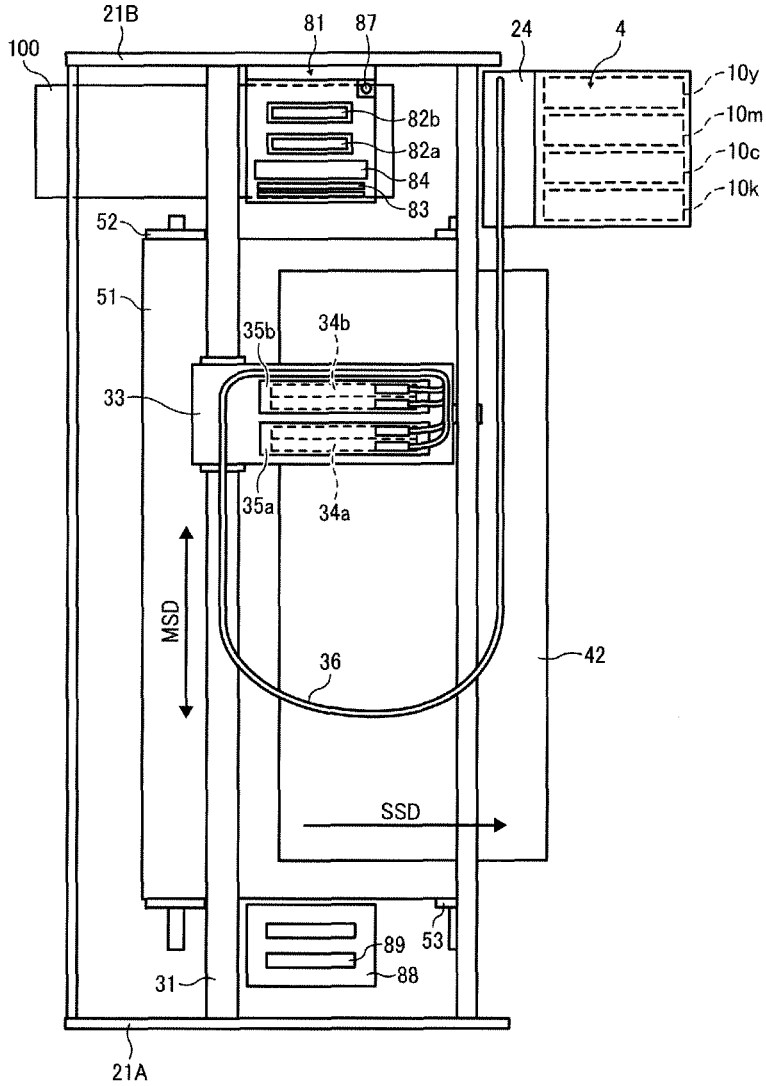
FIG. 2 is a partial plan view of the mechanical section of FIG. 1.

The conveyance belt 51 is an endless belt that is looped between a conveyance roller 52 and a tension roller 53 so as to circulate in a belt conveyance direction (sub-scanning direction indicated by an arrow SSD in FIG. 2).

The image forming apparatus also has a charging roller 56 serving as a charging device to charge the surface of the conveyance belt 51. The charging roller 56 is disposed so as to contact an outer surface of the conveyance belt 51 and rotate with the circulation of the conveyance belt 51. The conveyance roller 52 is rotated by a sub scanning motor via a timing belt, so that the conveyance belt 51 circulates in the belt conveyance direction.

The image forming apparatus further includes a sheet output section to output the sheet 42 on which an image has been formed by the recording heads 34. The sheet output section includes a separation claw 61 to separate the sheet 42 from the conveyance belt 51, a first output roller 62, a spur 63 serving as a second output roller, and a sheet output tray 3 disposed at a position lower than the first output roller 62.

A duplex unit 71 is detachably mounted on a rear face portion of the apparatus body 1. When the conveyance belt 51 rotates in reverse to return the sheet 42, the duplex unit 71 receives the sheet 42. Then, the duplex unit 71 reverses and feeds the sheet 42 to a nipping portion between the counter roller 46 and the conveyance belt 51. A manual feed tray 72 is formed at an upper face of the duplex unit 71.

As illustrated in FIG. 2, a maintenance device (maintenance and recovery device) 81 is disposed in a non-printing area (non-recording area) at one end in the main scanning direction of the carriage 33. The maintenance device 81 maintains and recovers nozzle conditions of the recording heads 34.

The maintenance device 81 includes caps 82*a* and 82*b*, a wiping member 83, a first dummy-ejection receptacle 84 and a carriage lock 87. The caps 82*a* and 82*b* (hereinafter collectively referred to as "caps 82" unless distinguished) cap nozzle faces of the recording heads 34. The wiping member (wiper blade) 83 wipes the nozzle faces of the recording heads 34. The first dummy-ejection receptacle 84 receives liquid droplets ejected by dummy ejection in which liquid droplets not contributing to image recording are ejected to remove viscosity-increased recording liquid. The carriage lock 87 locks the carriage 33.

Below the maintenance device 81, a waste liquid tank 100 is removably mounted to the apparatus body 1 to store waste ink or liquid discharged by the maintenance and recovery operation.

As illustrated in FIG. 2, a second dummy ejection receptacle 88 is disposed at a non-printing area on the opposite end in the main scanning direction of the carriage 33. The second dummy ejection receptacle 88 receives liquid droplets ejected, e.g., during recording (image forming) operation by dummy ejection in which liquid droplets not contributing to image recording are ejected to remove viscosity-increased recording liquid. The second dummy ejection receptacle 88 has openings 89 arranged in parallel to the nozzle rows of the recording heads 34.

In the image forming apparatus having the above-described configuration, the sheet 42 is separated sheet by sheet from the sheet feed tray 2, fed in a substantially vertically upward direction, guided along the first guide member 45, and conveyed while being sandwiched between the conveyance belt 51 and the counter roller 46. Further, the front end of the sheet 42 is guided by the conveyance guide member 47 and is pressed against the conveyance belt 51 by the front-end pressing roller 49 to turn the transport direction of the sheet 42 by approximately 90°.

At this time, positive and negative voltages are alternately supplied to the charging roller 56 so that plus outputs and minus outputs to the charging roller 56 are alternately repeated. As a result, the conveyance belt 51 is charged in an alternating voltage pattern, that is, so that positively charged areas and negatively charged areas are alternately repeated at a certain width in the sub-scanning direction SSD, i.e., the belt conveyance direction.

When the sheet 42 is fed onto the conveyance belt 51 alternately charged with positive and negative charges, the sheet 42 is adhered on the conveyance belt 51 and conveyed in the sub scanning direction by the circulation of the conveyance belt 51.

By driving the recording heads 34 in accordance with image signals while moving the carriage 33, ink droplets are ejected onto the sheet 42, which is stopped below the recording heads 34, to form one line of a desired image. Then, after the sheet 42 is fed by a certain distance, the recording heads 34 record another line of the image. Receiving a recording end signal or a signal indicating that the rear end of the sheet 42 has arrived at the recording area, the recording operation finishes and the sheet 42 is output to the sheet output tray 3.

To perform maintenance and recovery operation on the nozzles of the recording heads 34, the carriage 33 is moved to a home position at which the carriage 33 opposes the maintenance device 81. Then, the maintenance-and-recovery operation, such as nozzle sucking operation for sucking ink from nozzles with the nozzle faces of the recording heads 34 capped with the caps 82 and/or dummy ejection for ejecting liquid droplets not contributed to image formation, is performed, thus allowing image formation with stable droplet ejection.

Next, an example of the head tank 35 is described with reference to FIGS. 3 and 4.

Figure 3:
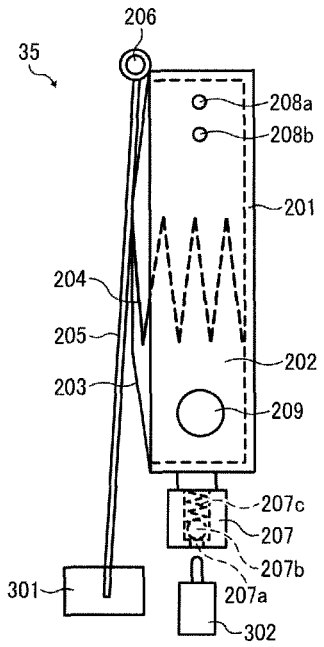
FIG. 3 is a schematic plan view of an example of a head tank.
Figure 4:
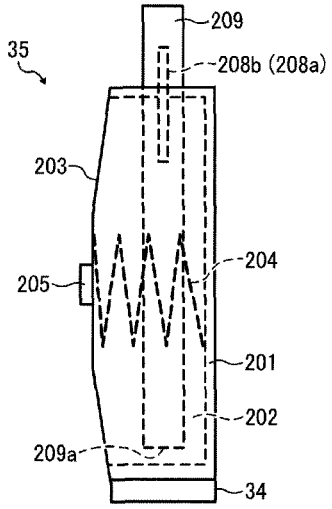
FIG. 4 is a schematic front view of the head tank illustrated in FIG. 3.

FIG. 3 is a schematic plan view of a portion of the head tank 35 corresponding to one recording head. FIG. 4 is a schematic front view of the head tank 35 of FIG. 3.

The head tank 35 has a tank case (tank housing) 201 forming a liquid storage portion 202 to store ink and having an opening at one side. The opening of the tank case 201 is sealed with a flexible film member 203, and a spring 204 serving as an elastic member is disposed within the tank case 201 to constantly urge the film member 203 outward. Thus, since an outward pressing force of the spring 204 acts on the film member 203 of the tank case 201, the remaining amount of ink in the tank case 201 decreases, thus creating negative pressure.

A displacement member (hereinafter, may also be referred to as simply "feeler") 205 having one end swingably supported by a shaft 206 is disposed outside the tank case 201. The displacement member 205 is urged toward the tank case 201 and pressed against the film member 203.

Thus, since the displacement member 205 displaces with movement of the film member 203, for example, the remaining amount of ink in the head tank 35 can be detected with a body-side sensor 301 serving as an optical sensor mounted to the apparatus body 1 to detect the displacement amount of the displacement member 205.

A supply port member 209 is disposed at an upper portion of the tank case 201 and connected to the supply tube 36 to supply ink from the ink cartridge 10.

At one side of the tank case 201, an air release unit 207 is disposed to release an interior of the head tank 35 to the atmosphere. The air release unit 207 includes an air release passage 207*a* communicated with the interior of the head tank 35, a valve body 207*b* to open and close the air release passage 207*a*, and a spring 207*c* to press the valve body 207*b* into a closed state. An air release solenoid 302 is disposed at the apparatus body 1 to push the valve body 207*b*. When the valve body 207*b* is pushed by the air release solenoid 302, the air release passage 207*a* opens, thus releasing the interior of the head tank 35 to the atmosphere (in other words, causing the interior of the head tank 35 to be communicated with the atmosphere).

In an upper portion of the tank case 201 are disposed electrode pins 208*a* and 208*b* (collectively referred to as electrode pins 208 unless distinguished) serving as a liquid level detector to detect the liquid level of ink in the liquid storage portion 202. Since ink has conductivity, when ink reaches the electrode pins 208*a* and 208*b*, electric current flows between the electrode pins 208*a* and 208*b* and the resistance values of the electrode pins 208*a* and 208*b* change. Such a configuration can detect that the liquid level of ink has decreased to a threshold level or lower, i.e., the amount of air in the head tank 35 has increased to a threshold amount or more, or that remaining amount of ink in the head tank 35 has decreased to a threshold level or lower.

The supply port member 209 extends near a bottom portion of the liquid storage portion 202 and has an opening (supply port) 209*a* at a lowermost end thereof. The opening 209*a* is disposed at a position lower than the electrode pins 208 serving as the liquid level detector.

Figure 5:
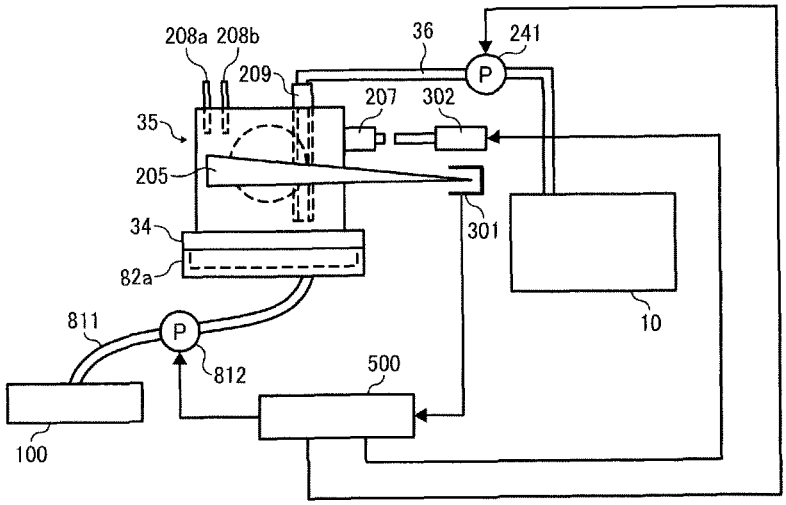
FIG. 5 is a schematic view of a liquid supply-and-discharge system.

Next, a liquid supply-and-discharge system of the image forming apparatus according to an exemplary embodiment of this disclosure is described with reference to FIG. 5.

A liquid feed pump 241 serving as a liquid feed device of the supply pump unit 24 feeds ink from the ink cartridge 10 (hereinafter, may also be referred to as main tank) to the head tank 35 via the supply tube 36 (also referred to as supply passage).

The liquid feed pump 241 is a reversible pump, e.g., a tube pump, to perform both normal feed operation to feed ink from the ink cartridge 10 to the head tank 35 and reverse feed operation to return ink from the head tank 35 to the ink cartridge 10.

The maintenance device 81, as described above, has the cap (suction cap) 82*a* to cap the nozzle face of any of the recording heads 34 and a suction pump 812 connected to the suction cap 82*a* via a suction tube 811. The suction pump 812 is driven with the nozzle face capped with the suction cap 82*a* to suck ink from the nozzles via the suction tube 811, thus allowing ink to be sucked from the head tank 35. Waste ink sucked from the head tank 35 is discharged to the waste liquid tank 100.

The air release solenoid 302 serving as a pressing member to open and close the air release unit 207 of the head tank 35 is disposed at the apparatus body 1. The air release unit 207 can be opened by activating the air release solenoid 207. On the apparatus body 1 is mounted the body-side sensor 301 serving as an optical sensor to detect the displacement member 205 of the head tank 35.

Next, the liquid feed pump 241 serving as a reversible pump is described with reference to FIG. 6.

Figure 6:
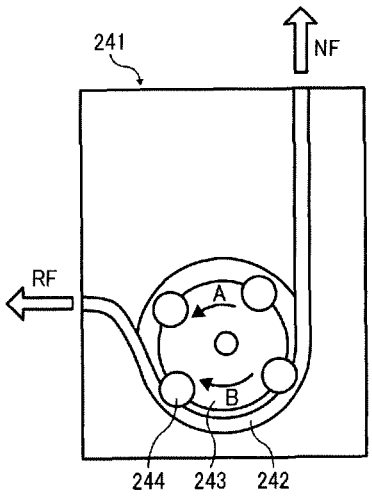
FIG. 6 is a schematic view of an example of a liquid feed pump.

FIG. 6 is a schematic view of the liquid feed pump 241 according to an exemplary embodiment of this disclosure.

The liquid feed pump 241 is a tube pump including a tube 242, a rotary body 243, and compression rollers 244. The tube 242 for liquid feeding winds in the liquid feed pump 241, and the compression rollers 244 are held by the rotary body 243 to compress the tube 242. By rotating the rotary body 243, one or more compression points of the tube 242 compressed by one or more of the compression rollers 244 move in a rotation direction of the rotary body 243, thus feeding ink in a rotation direction of the compression rollers 244.

For example, when ink is fed from the ink cartridge 10 to the head tank 35 in a direction indicated by an arrow NF in FIG. 6 (normal rotation feeding), the compression rollers 244 rotate in a rotation direction indicated by an arrow A in FIG. 6. By contrast, when ink is fed in reverse from the head tank 35 to the ink cartridge 10 in a direction indicated by an arrow RF in FIG. 6 (reverse rotation feeding), the compression rollers 244 rotate in a rotation direction indicated by an arrow B opposite to the direction indicated by the arrow A in FIG. 6.

Next, an outline of a controller of the image forming apparatus is described with reference to FIG. 7.

Figure 7:
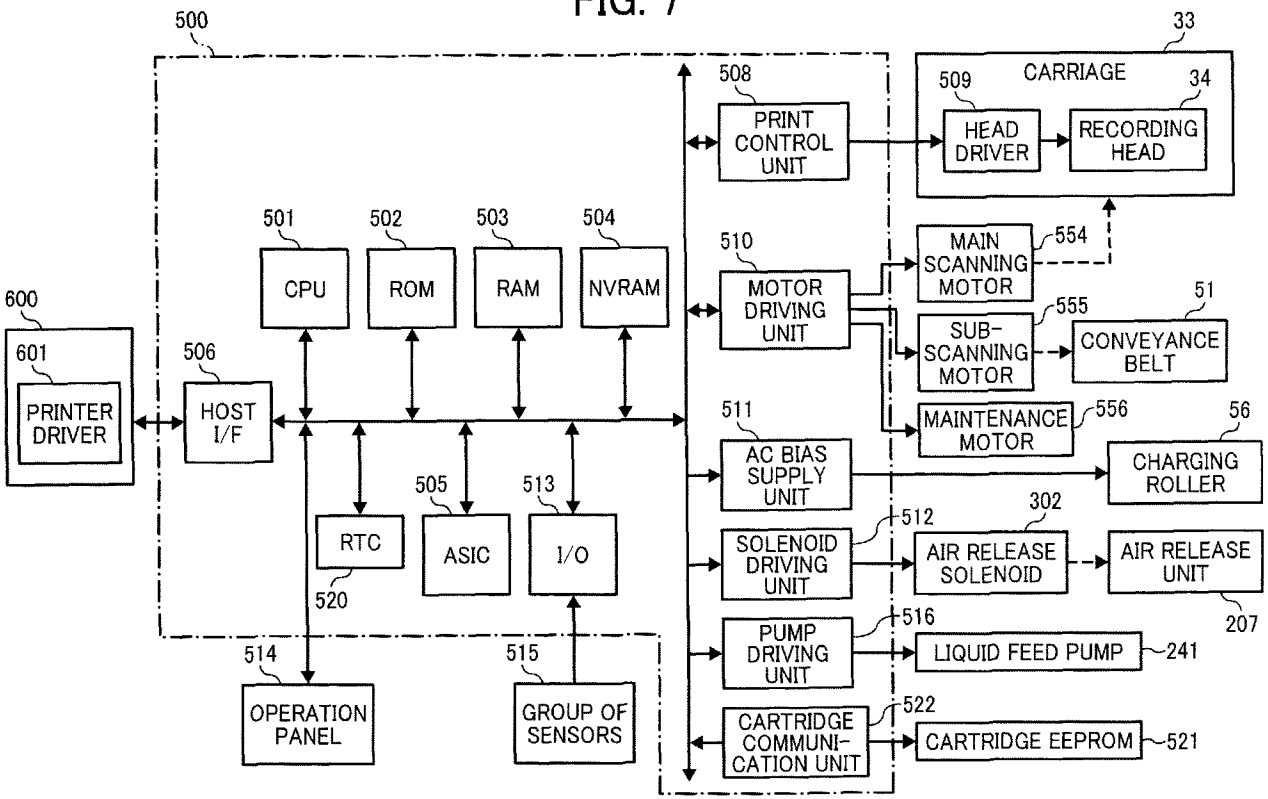
FIG. 7 is a schematic block diagram of an example of a controller of the image forming apparatus.

FIG. 7 is a block diagram of a controller 500 according to an exemplary embodiment of this disclosure.

The controller 500 includes a central processing unit (CPU) 501, a read-only memory (ROM) 502, a random access memory (RAM) 503, a non-volatile random access memory (NVRAM) 504, and an application-specific integrated circuit (ASIC) 505. The CPU 501 manages control of the entire image forming apparatus. The ROM 502 stores programs including programs for causing the CPU 501 to execute control of supply operation and measurement of liquid consumption amount according to at least one exemplary embodiment of this disclosure and other fixed data. The RAM 503 temporarily stores image data and other data. The NVRAM 504 is a rewritable memory capable of retaining data even while the apparatus is powered off. The ASIC 505 processes various signals on image data, performs sorting or other image processing, and processes input and output signals to control the entire apparatus.

The controller 500 also includes a print control unit 508, a head driver (driver integrated circuit) 509, a main scanning motor 554, a sub-scanning motor 555, a motor driving unit 510, an alternating current (AC) bias supply unit 511, a solenoid driving unit 512, a pump driving unit 516, and a cartridge communication unit 522. The print control unit 508 includes a data transmitter and a driving signal generator to drive and control the recording heads 34. The head driver 509 drives the recording heads 34 mounted on the carriage 33. The motor driving unit 510 drives the main scanning motor 554 to move the carriage 33 for scanning, drives the sub-scanning motor 555 to circulate the conveyance belt 51, and drives the maintenance motor 556 of the maintenance device 81. The AC bias supply unit 511 supplies AC bias to the charging roller 56. The solenoid driving unit 512 drives the air release solenoid 302 to open and close the air release unit 207 of the head tank 35. The pump driving unit 516 drives the liquid feed pump 241. The cartridge communication unit 522 performs communication to read and write data from and into an electrically erasable programmable read-only memory (EEPROM) 521 serving as a non volatile memory disposed at the ink cartridge 10.

The controller 500 is connected to an operation panel 514 for inputting and displaying information in the image forming apparatus.

The controller 500 includes a host interface (I/F) 506 for transmitting and receiving data and signals to and from a host 600, such as an information processing device (e.g., personal computer), image reading device (e.g., image scanner), or imaging device (e.g., digital camera), via a cable or network.

The CPU 501 of the controller 500 reads and analyzes print data stored in a reception buffer of the host I/F 506, performs desired image processing, data sorting, or other processing with the ASIC 505, and transfers image data to the head driver 509. Dot-pattern data for image output may be created by a printer driver 601 of the host 600.

The print control unit 508 transfers the above-described image data as serial data and outputs to the head driver 509, for example, transfer clock signals, latch signals, and control signals for the transfer of image data and determination of the transfer. In addition, the print control unit 508 has the driving signal generator including, e.g., a digital/analog (D/A) converter (to perform digital/analog conversion on pattern data of driving pulses stored on the ROM 502), a voltage amplifier, and a current amplifier, and outputs a driving signal containing one or more driving pulses to the head driver 509.

In accordance with serially-inputted image data corresponding to one image line recorded by the recording heads 34, the head driver 509 selects driving pulses forming driving signals transmitted from the print control unit 508 and applies the selected driving pulses to driving elements (e.g., piezoelectric elements) to drive the recording heads 34. At this time, the driving elements serve as pressure generators to generate energy for ejecting liquid droplets from the recording heads 34. At this time, by selecting a part or all of the driving pulses forming the driving signals, the recording heads 34 can selectively eject different sizes of droplets, e.g., large droplets, medium droplets, and small droplets to form different sizes of dots on a recording medium.

An input/output (I/O) unit 513 acquires information from a group of sensors 515 mounted in the image forming apparatus, extracts information for controlling printing operation, and controls the print control unit 508, the motor driving unit 510, and the AC bias supply unit 511 based on such extracted information. The group of sensors 515 includes, for example, an optical sensor to detect the position of a sheet of recording media, a thermistor to monitor temperature and/or humidity in the apparatus, a voltage sensor to monitor the voltage of the conveyance belt charged, and an interlock switch to detect the opening and closing of a cover. The I/O unit 513 is capable of processing various types of information transmitted from the group of sensors 515. Signals from, e.g., the body-side sensor 301 to detect the displacement member 205 of the head tank 35 and the electrode pins 208*a* and 208*b* to detect the liquid level in the head tank 35 are also input to the input/output unit 513.

The controller 500 further includes a timer 520 to measure time.

Next, change in the liquid level of the head tank 35 in response to several operations of the head tank 35 and movement of the film member 203 are described with reference to FIGS. 8A to 8C.

Figure 8A:
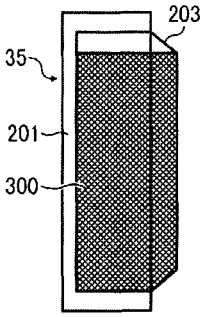
FIGS. 8A, 8B, and 8C are illustrations showing change in the liquid level of ink in a head tank and movement of a film member.

FIG. 8A is a state in which, with ink 300 stored in the head tank 35, a negative pressure is formed in the head tank 35 and the air release unit 207 is closed. When the air release unit 207 is opened from the state of FIG. 8A, as illustrated in FIG. 8C, the film member 203 displaces outward and the liquid level of ink moves down.

Figure 8B:
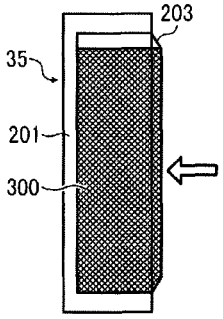
Figure 8C:
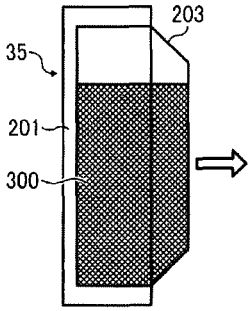

In a state of FIG. 8C, the liquid feed pump 241 is driven for forward rotation to feed ink from the main tank 10 to the head tank 35. As a result, as illustrated in FIG. 8A, the liquid level of ink moves up. When the electrode pins 208 detect the liquid level of ink in the head tank 35, the air release unit 207 is closed. (A state of the head tank 35 at this time is referred to as ink full state.)

When a desired amount of ink is discharged from the head tank 35 in the ink full state illustrated in FIG. 8A, the film member 203 moves inward and a negative pressure is formed in the head tank 35 illustrated in FIG. 8B. For such ink discharge for generating a negative pressure, the liquid level of ink in the head tank 35 does not substantially change.

For such ink discharge from the head tank 35, for example, with the nozzle face of a recording head 34 capped with the suction cap 82*a*, the suction pump 812 may be driven to suck and discharge ink from nozzles of the recording head 34. Alternatively, in one embodiment, the liquid feed pump 241 may be driven for reverse rotation to feed ink in reverse from the head tank 35 to the main tank 10 for ink discharge. In one embodiment, the recording head 34 may be driven to eject ink droplets for ink discharge.

Next, parameters and terms used below are described.

<Parameters on Consumption Amount>

V: Liquid Consumption Amount Count (or Liquid Consumption Amount Count Value)

In this exemplary embodiment, the image forming apparatus measures the consumption amount of ink (Liquid consumption amount) with a counter (serving as a measurement unit and referred to as soft counter) implemented as a program (s). In other words, the liquid consumption amount (ink consumption amount) by image formation is calculated as a total of ejected droplet amounts for different droplet sizes, each of which is obtained by multiplying the volume of a droplet per size by the number of ejected droplets per size. Similarly, the liquid consumption amount in dummy ejection operation, in which droplets not contributing to image formation are ejected from a recording head 34, is calculated as a total of ejected droplet amounts for different droplet sizes, each of which is obtained by multiplying the volume of a droplet per size by the number of ejected droplets per size. In addition, the amount (preset amount) of ink consumed by sucking ink into the cap 82*a* in maintenance and recovery operation is added to V.

On completion of ink filling to the head tank 35, the liquid consumption amount count V is reset to zero (and simultaneously added to the consumption amount of ink in the ink cartridge 10). In addition, at the end of cleaning operation, the liquid consumption amount count V is reset to zero (and simultaneously added to the consumption amount of ink in the ink cartridge 10).

X: Temporarily Stored Value of Liquid Consumption Amount Count (Consumption Amount of Ink in Head Tank)

The value X represents a height of the liquid level of ink in the head tank 35. For example, after a time out of liquid supply occurs, the liquid consumption amount count V of the head tank 35 is stored as the temporarily stored value X. Then, the liquid consumption amount after closing of the air release unit 207 hardly affect the height of the liquid level of ink in the head tank 35. As a result, in a case in which, after the time out of liquid supply, the air release unit 207 is closed and liquid is consumed, the temporarily stored value X becomes a more accurate indicator of the height of the liquid level of ink in the head tank 35 than the liquid consumption amount count V.

Y: Threshold Value (First Threshold Value)

When the temporarily stored value X cc of the liquid consumption amount count V is a first threshold value Y cc or lower, the value Y cc is set so that the liquid level (surface) of ink in the head tank 35 contacts the supply port 209*a* of the supply port member 209 of the head tank 35. In such a case, taking variations of the value X cc into consideration, the value Y cc is set so that the liquid level of ink in the head tank 35 contacts the supply port 209*a* even if the value X cc is a maximum of the variations. The term "cc" used herein represents a unit code, and X cc represents the value X in units of cc.

Z: Threshold Value (Second Threshold Value)

When the temporarily stored value X cc of the liquid consumption amount count V is a second threshold value Z cc or greater, the value Z cc is set so that the liquid level of ink in the head tank 35 does not contact the supply port 209*a* of the supply port member 209 of the head tank 35. In such a case, taking variations of the value X cc into consideration, the value Z cc is set so that the liquid level of ink in the head tank 35 does not contact the supply port 209*a* even if the value X cc is a maximum of the variations.

<Parameters on Maintenance Suction>

One parameter is liquid consumption amount of maintenance suction for negative pressure generation, i.e., suction for discharging liquid from the recording head 34 to generate a negative pressure in the head tank 35.

Another parameter is liquid consumption amount of maintenance suction for cleaning, i.e., suction for discharging liquid from nozzles of the recording head 34 to clean the nozzle face of the recording head 34. The liquid consumption amount of maintenance suction for cleaning is smaller than the liquid consumption amount of maintenance suction for negative pressure generation.

<Operations Relating to Liquid Supply Filling>

Normal filling: operation according to a normal filling sequence described below.

Over filling: operation basically similar to normal filling but different from normal filling in that over filling fills a little more liquid to the head tank 35 than normal filling. Over filling fills more liquid to the head tank 35 than normal filling by approximately a liquid consumption amount consumed by maintenance suction for cleaning and dummy ejection performed after over filling.

Figure 9:
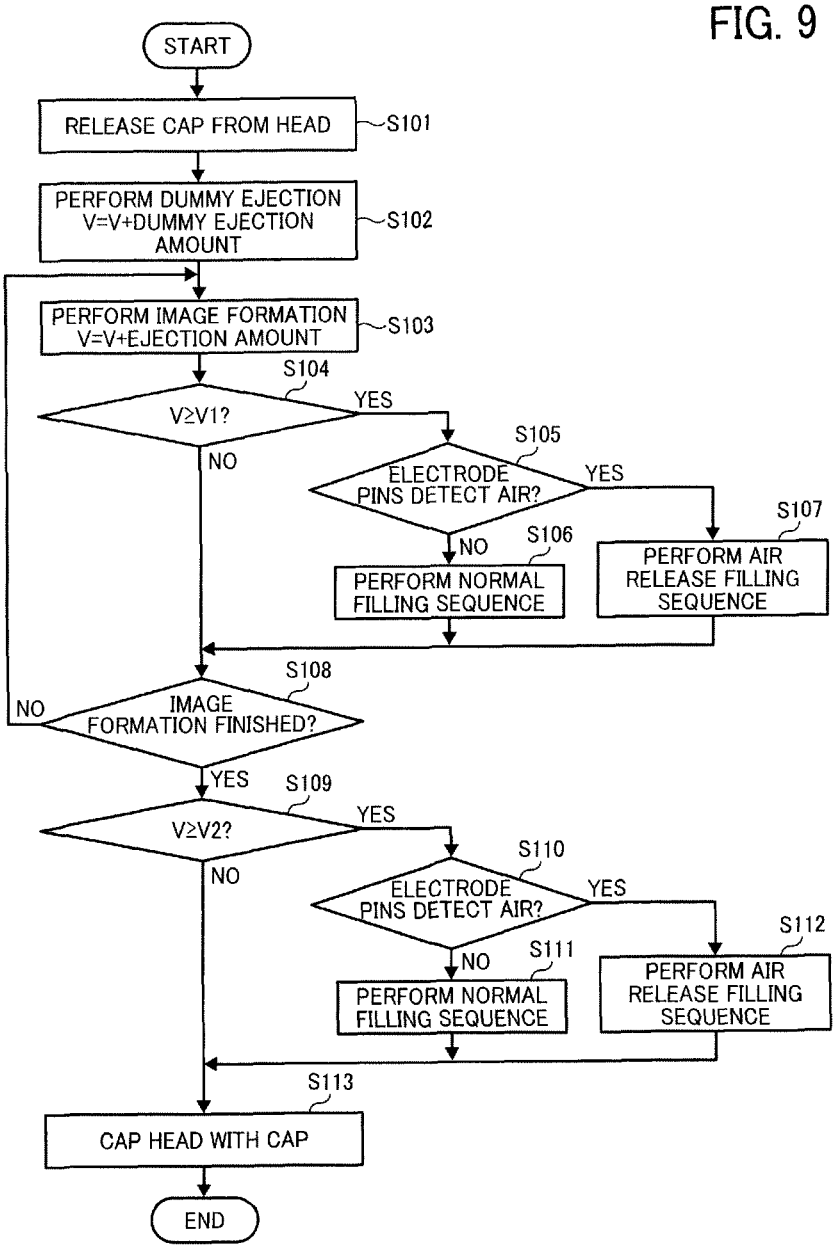
FIG. 9 is a flowchart showing ink supply (filling) timing and types of ink supply operation (filling operation) of the image forming apparatus.

Next, ink supply (filling) timing and types of ink supply operation (filling operation) of the image forming apparatus according to an exemplary embodiment of this disclosure is described with reference to FIG. 9.

When printing operation starts, at S101 capping of the recording head 34 with the caps 82 is released.

At S102, dummy ejection is performed to eject from the recording head 34 liquid droplets not contributing to image formation, and the amount of liquid ejected in the dummy ejection is added to a liquid consumption amount count V (V=V+dummy ejection amount).

At S103, image formation is performed and the amount of liquid ejected in the image formation is added to the liquid consumption amount count V (V=V+ejection amount).

At S104, for example, in an interval between pages in image formation, the controller 500 determines whether or not the liquid consumption amount count V is a threshold amount V1 (corresponding to, e.g., 0.5 cc) or greater.

When the liquid consumption amount count V is less than the threshold amount V1 (NO at S104), at S108 the controller 500 determines whether or not image formation is finished.

By contrast, when the liquid consumption amount count V is the threshold amount V1 or greater (YES at S104), at S105 the controller 500 determines whether or not the electrode pins 208 of the head tank 35 detect air. When the electrode pins 208 of the head tank 35 do not detect air (NO at S105), at S106 the controller 500 performs normal filling sequence and at S108 determines whether or not image formation is finished. By contrast, when the electrode pins 208 of the head tank 35 detect air (YES at S105), at S107 the controller 500 performs air release filling sequence and at S108 determines whether or not image formation is finished.

The above-described processing (from S103 to S108) is repeated until image formation is finished. After image formation is finished (YES at S108), at S109 the controller 500 determines whether or not the liquid consumption amount count V is a second threshold amount V2 (corresponding to, e.g., 0.7 cc which is greater than V1).

When the liquid consumption amount count V is less than the second threshold amount V2 (NO at S109), at S113 the controller 500 causes the cap 82 to cap the recording head 34 and the process ends.

By contrast, when the liquid consumption amount count V is the second threshold amount V2 or greater (YES at S109), at S110 the controller 500 determines whether or not the electrode pins 208 of the head tank 35 detect air. When the electrode pins 208 do not detect air (NO at S110), at S111 the controller 500 performs normal filling sequence. By contrast, when the electrode pins 208 detect air (YES at S110), at S112 the controller 500 performs air release filling sequence. At S113, the controller 500 causes the cap 82 to cap the recording head 34 and the process ends.

In the above-described process, the air release unit 207 of the head tank 35 is closed during image formation. Thus, even when liquid (ink) is consumed, the height of the liquid level of ink in the head tank 35 does not change. As a result, the electrode pins 208 rarely detect air and the process is likely to go to the normal filling sequence.

However, even in such closed state of the air release unit 207, a slight amount of air in the ink cartridge (main tank) 10 may move to and accumulate in the head tank 35 by repeated ink filling. Alternatively, as the liquid consumption amount in the head tank 35 increases, the liquid level may slightly decrease by an amount corresponding to a distance at which the film member 203 does not contract. When the height of the liquid level of ink in the head tank 35 decreases and the electrode pins 208 detect air, the controller 500 performs air release filling sequence.

Figure 10:
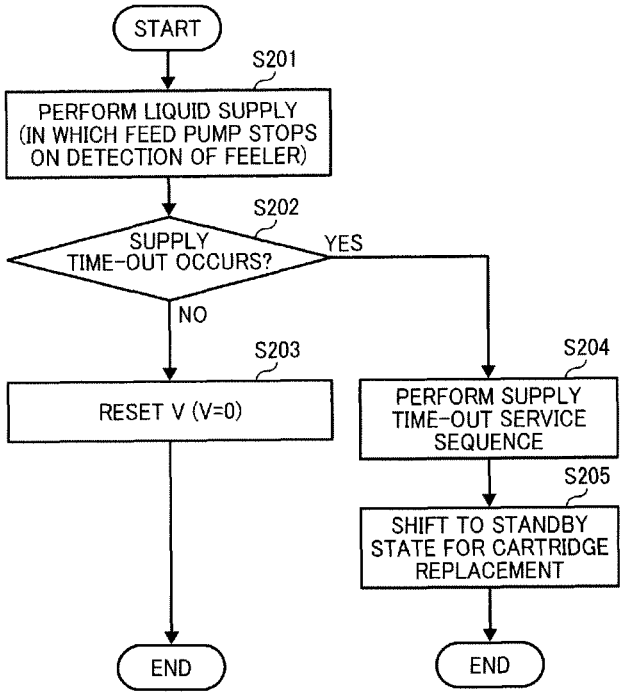
FIG. 10 is a flowchart of a normal filling sequence.

Next, a normal filling sequence is described with reference to FIG. 10.

At S201, in a state in which the carriage 33 is placed at a normal filling ink-full position and the air release unit 207 is closed, the liquid feed pump 241 is driven for forward rotation to feed ink from the ink cartridge 10 to the head tank 35. In such a case, when the body-side sensor 301 detects the displacement member 205 of the head tank 35, the controller 500 stops the ink feeding of the liquid feed pump 241.

At S202, the controller 500 determines whether or not a threshold time passes (a time out of ink supply occurs) before the body-side sensor 301 detects the displacement member 205 of the head tank 35.

When the body-side sensor 301 detects the displacement member 205 of the head tank 35 without the time out of ink supply (NO at S202), at S203 the controller 500 stops the liquid feed pump 241 and resets the liquid consumption amount count V to zero (V=0).

By contrast, when the time out of ink supply occurs before the body-side sensor 301 detects the displacement member 205 (YES at S202), at S204 the controller 500 determines the remaining amount of ink in the ink cartridge 10 is deficient, and performs a supply time-out service sequence. At S205, the controller 500 shifts to a standby state for replacement of the ink cartridge 10.

Figure 11:
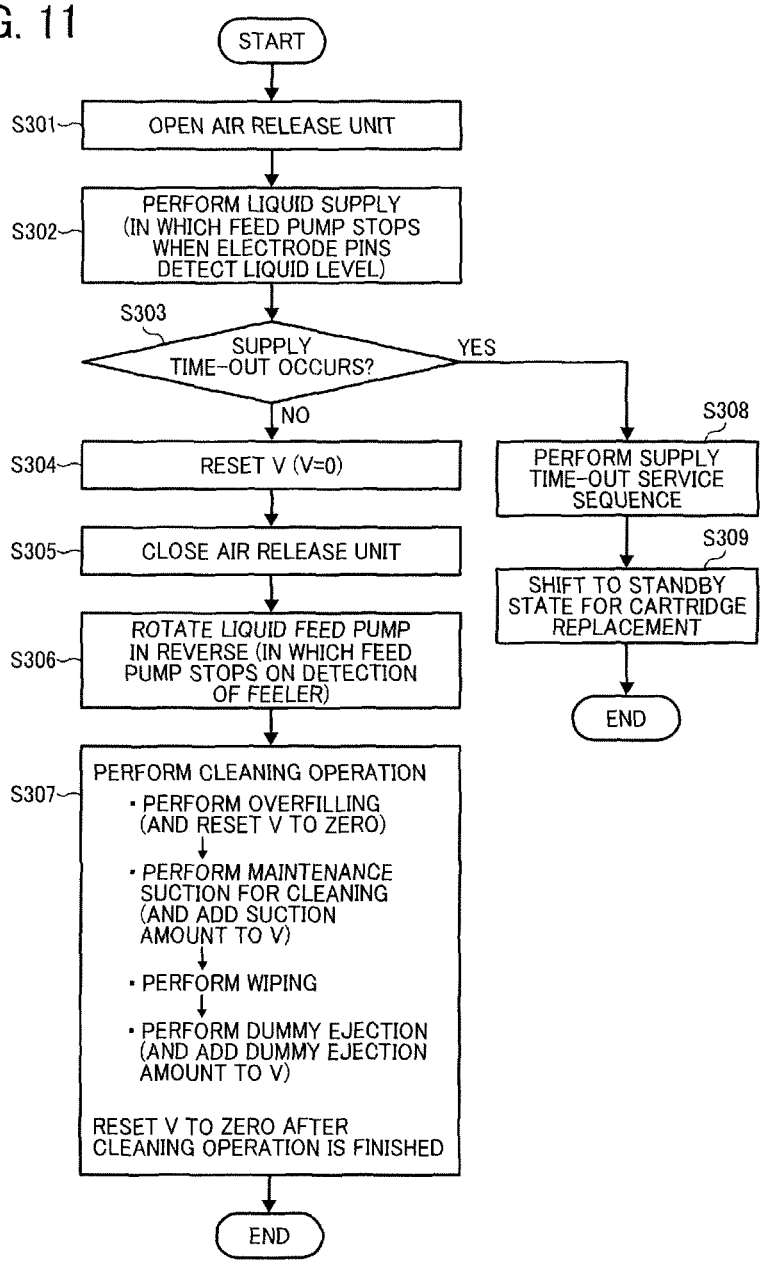
FIG. 11 is a flowchart of an air release filling sequence.

Next, an air release filling sequence is described with reference to FIG. 11.

At S301, the controller 500 opens the air release unit 207, and at S302 the liquid feed pump 241 is driven for forward rotation to feed ink from the ink cartridge 10 to the head tank 35. In such a case, when the electrode pins 208 detects the liquid level of ink in the head tank 35, the controller 500 stops the ink feeding of the liquid feed pump 241.

At S303, the controller 500 determines whether or not a threshold time passes (a time out of ink supply occurs) before the body-side sensor 301 detects the displacement member 205 of the head tank 35.

When the body-side sensor 301 detects the displacement member 205 of the head tank 35 without the time out of ink supply (NO at S303), at S304 the controller 500 stops the liquid feed pump 241 and resets the liquid consumption amount count V to zero (V=0).

At S305, the controller 500 closes the air release unit 207. At S306, the liquid feed pump 241 is driven for reverse rotation to feed ink in reverse from the head tank 35 to the ink cartridge 10. In such a case, when the body-side sensor 301 detects the displacement member 205 of the head tank 35, the controller 500 stops the reverse feeding of the liquid feed pump 241.

The reverse feeding creates a negative pressure in the head tank 35. At S307, the controller 500 performs cleaning operation as follow. In the cleaning operation, for example, the controller 500 performs over filling of ink to the head tank 35, resets the liquid consumption amount count V to zero (V=0), performs maintenance suction for cleaning (sucks ink from the nozzles of the recording head 34), adds the amount of ink sucked to the liquid consumption amount count V, performs wiping of the nozzle face of the recording head 34 with the wiping member 83, performs dummy ejection, adds the amount of ink ejected by the dummy ejection to the liquid consumption amount count V, and rests the liquid consumption amount count V to zero (V=0) at the end of cleaning operation.

By contrast, when the time out of ink supply occurs before the body-side sensor 301 detects the displacement member 205 (YES at S303), at S308 the controller 500 determines that the remaining amount of ink in the ink cartridge 10 is deficient, and performs a supply time-out service sequence. At S309, the controller 500 shifts to a standby state for replacement of the ink cartridge 10.

Next, a supply time-out service sequence according to a first exemplary embodiment of this disclosure is described with reference to FIG. 12.

At S401, the controller 500 determines whether or not a time out occurs in ink filling in which the liquid feed pump 241 is to be stopped on detection of the liquid level with the electrode pins 208.

When a time out does not occur in ink filling in which the liquid feed pump 241 is to be stopped on detection of the liquid level with the electrode pins 208 (NO at S401), for example, a time out occurs in ink filling in which the liquid feed pump 241 is to be stopped on detection of the displacement member 205, it can be assumed that the liquid level would not be lowered. Hence, at S406 the controller 500 drives the liquid feed pump 241 for reverse rotation to feed ink in reverse from the head tank 35 to the ink cartridge 10.

If ink is not fed in reverse from the head tank 35 to the ink cartridge 10, the liquid feed pump 241 may become an excessive state of negative pressure. In such a state, when the ink cartridge 10 is removed from the apparatus body 1, air would be inhaled into the liquid feed pump 241 and sent into the head tank 35 in the form of bubbles, thus resulting in ejection failure.

By contrast, in this exemplary embodiment, by feeding ink in reverse from the head tank 35 to the ink cartridge 10, such excessive negative-pressure state of the liquid feed pump 241 is released, thus preventing air from being inhaled into the liquid feed pump 241 on removal of the ink cartridge 10.

By contrast, when a time out occurs in ink filling in which the liquid feed pump 241 is to be stopped on detection of the liquid level with the electrode pins 208 (YES at S401), at S402 the controller 500 closes the air release unit 207.

At S403, the controller 500 stores the consumption amount X cc of ink in the head tank 35 (X cc=V cc).

At S404, the controller 500 performs restoring operation of negative pressure in the head tank 35. The negative-pressure restoring operation includes maintenance suction for creating a negative pressure, wiping operation, and dummy ejection operation (in the maintenance suction and dummy ejection operation, the liquid consumption amount count V is updated).

Figure 12:
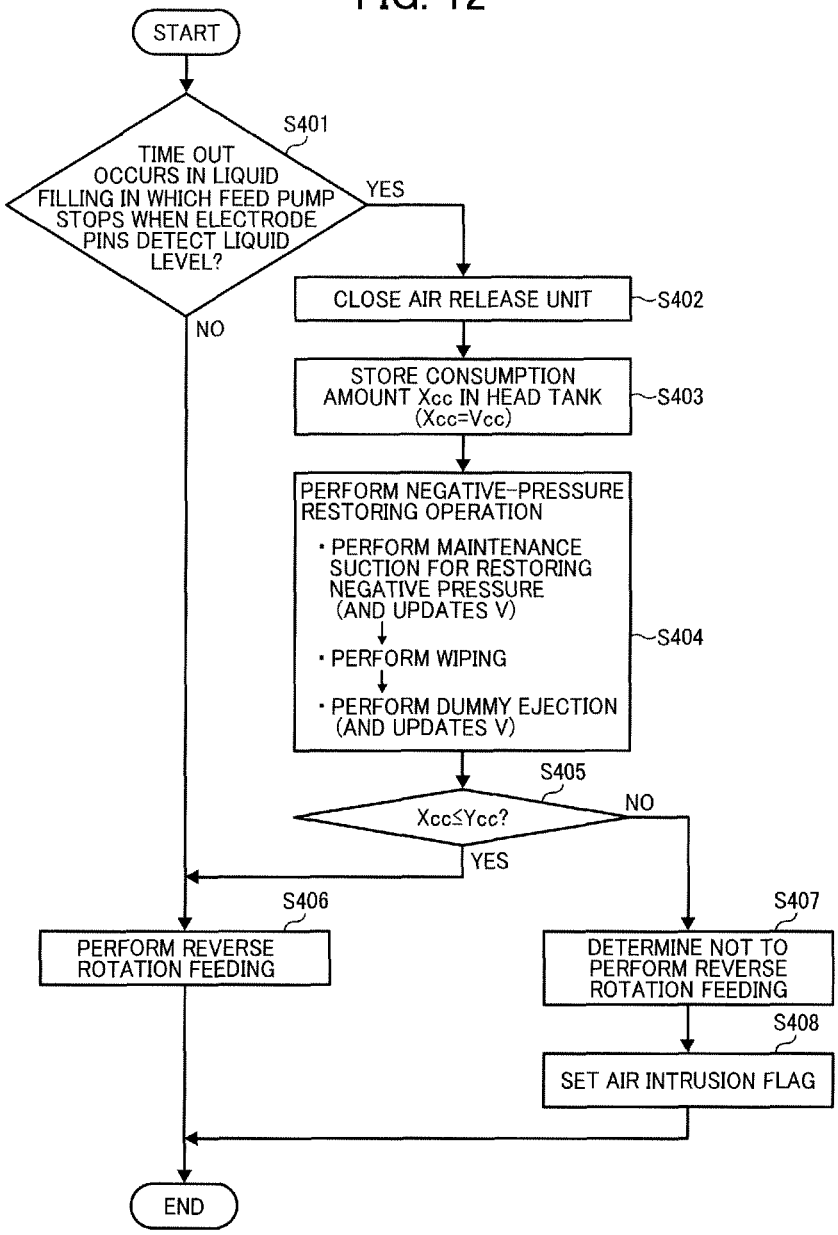
FIG. 12 is a flowchart of a supply time-out service sequence according to a first exemplary embodiment of this disclosure.

One reason that maintenance suction is performed rather than reverse rotation feeding in the sequence of FIG. 12 is that ink might run and stay on the nozzle face because negative pressure is not formed yet and, if reverse rotation feeding is performed in such a state, ink on the nozzle face might enter nozzles and mix with other color ink.

In this time, since the air release unit 207 is closed as described above, liquid consumption of the negative-pressure restoring operation hardly affects the height of the liquid level of ink in the head tank 35.

At S405, the controller 500 compares the consumption amount X cc of ink in the head tank 35 with a threshold value Y cc (e.g., 1 cc) and determines whether or not X cc is Y cc or smaller.

When X cc is Y cc or smaller (YES at S405), at S406 the controller 500 determines that the liquid level of ink in the head tank 35 is not lowered, and performs reverse rotation feeding to feed ink in reverse from the head tank 35 to the ink cartridge 10. By contrast, when X cc is greater than Y cc (NO at S405), at S407 the controller 500 determines that the liquid level of ink in the head tank 35 is lowered, and does not perform reverse rotation feeding. At S408, the controller 408 sets an air intrusion flag.

As described above, when the count value by the soft counter (liquid consumption amount measured) is the threshold amount (Y cc) or lower, the controller 500 performs reverse rotation feeding with the liquid feed pump. Such a configuration expands the range of conditions in which the controller 500 determines that reverse rotation feeding is available, thus minimizing the risk that bubbles might intrude on replacement of the ink cartridge 10.

The soft counter may be configured so as not to count (measure) a part or all of the consumption amount of ink in the head tank 35 after the air release unit 207 is closed from the open state. Such a configuration can expand the range of conditions in which he controller 500 determines that reverse rotation feeding is available.

Figure 13:
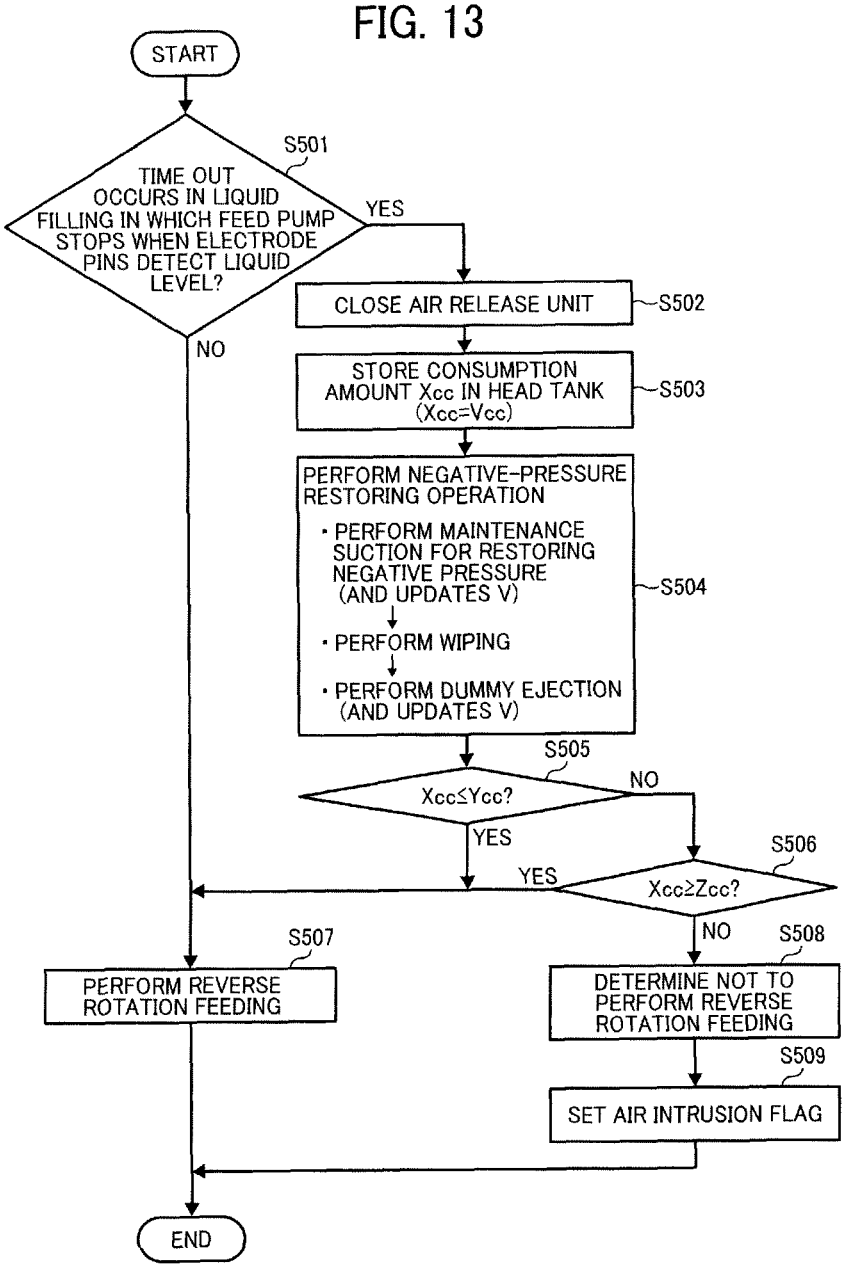
FIG. 13 is a flowchart of a supply time-out service sequence according to a second exemplary embodiment of this disclosure.

Next, a supply time-out service sequence according to a second exemplary embodiment of this disclosure is described with reference to FIG. 13.

In this exemplary embodiment, when a time out occurs in ink filling in which the liquid feed pump 241 is to be stopped on detection of the liquid level with the electrode pins 208 (YES at S501), similarly with the first exemplary embodiment illustrated in FIG. 12, at S502 the controller 500 closes the air release unit 207, and at S503 stores the consumption amount X cc of ink in the head tank 35 (X cc=V cc). At 5504, the controller 500 performs restoring operation of negative pressure in the head tank 35 and at S505 determines whether or not the consumption amount of ink X cc in the head tank 35 is a threshold amount Y cc (e.g., 1 cc) or smaller. When X cc is Y cc or smaller (YES at S505), like the first exemplary embodiment, at S507 the controller 500 performs reverse rotation feeding. When X cc is greater than Y cc (NO at S505), at S506 the controller 500 determine whether X cc is a second threshold value Z cc (e.g., 2.5 cc) or greater. When X cc is the second threshold value Z cc or greater (YES at S506), at S507 the controller 500 performs reverse rotation feeding. By contrast, when X cc is smaller than the second threshold value Z cc (NO at S506), at S508 the controller determines not to perform reverse rotation feeding and at S509 sets an air intrusion flag.

The condition that the consumption amount of ink X cc in the head tank 35 is the second threshold amount Z cc or greater (X cc≥Z cc) represents a condition that the liquid level of ink is reliably away from the supply port 209*a* of the supply port member 209.

Figure 14A:
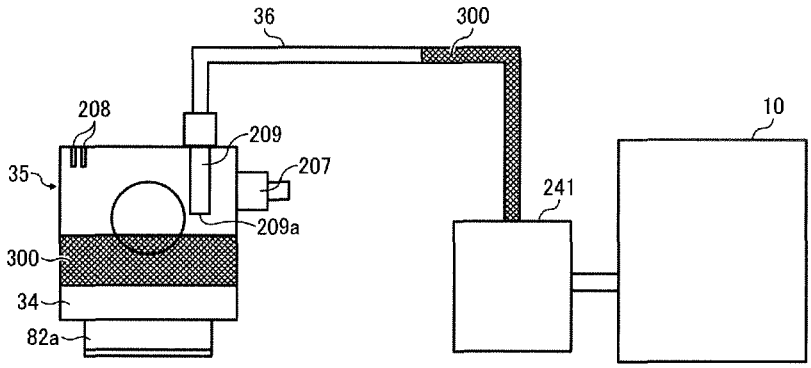
FIGS. 14A and 14B are illustrations showing operations of a liquid supply system in the supply time-out service sequence according to the second exemplary embodiment.

In other words, as illustrated in FIG. 14A, in the condition of X cc being Z cc or greater (e.g., X cc=3.0 cc) that the liquid level of ink in the head tank 35 is fully away from the supply port 209*a* of the supply port member 209, even when the controller 500 performs reverse rotation feeding, air forms a linear shape in the supply passage 36. Even when such air is delivered to the head tank 35 with the liquid level away from the supply port 209*a*, such air does not become bubbles (directly enters an air layer in the head tank 35), thus not adversely affecting the image forming apparatus.

Figure 14B:
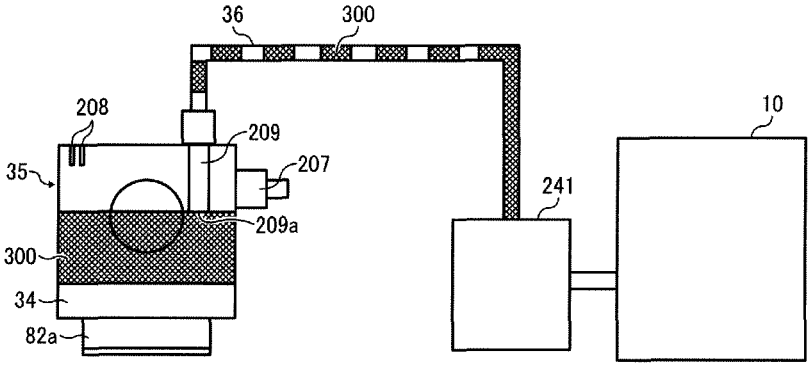

By contrast, as illustrated in FIG. 14B, the liquid level of ink in the head tank 35 may slightly contact the supply port 209*a* of the supply port member 209 by, e.g., surface tension (Y cc<X cc<Z cc: e.g., X cc=2.0 cc). In such a state, when reverse rotation feeding is performed, air is inhaled to the supply passage 36 to form spots. If such air spots are delivered to the head tank 35, bubbles arise in the head tank 35, thus resulting in ejection failure.

As described above, in this exemplary embodiment, when the consumption amount of ink X cc in the head tank 35 is a threshold amount Z cc (e.g., 2.5 cc) or greater (X cc≥Z cc), reverse rotation feeding is available. Such a configuration can expand the range of conditions in which reverse rotation feeding can be performed, thus minimizing the risk of intrusion of bubbles on replacement of the main tank 10.

Next, a method of determining the above-described first threshold value Y cc and second threshold value Z cc according to an exemplary embodiment is described below.

For the configuration of the head tank 35 in this exemplary embodiment, when ink is supplied to the head tank 35 with the air release unit 207 open, for example, the amount of ink in the head tank 35 is assumed to be 4.822 cc with the liquid level placed below the electrode pins 208 and 2.555 cc with the liquid level placed below the supply port 209*a* of the supply port member 209.

For the liquid consumption amount count V, taking the normal filling ink-full state (after normal filling sequence) as a starting point, V cc is added. The normal filling ink-full position is a position at which the amount of ink in the head tank 35 is smaller than an ink full state in which the electrode pins 208 detects the liquid level by the amount of ink consumed for creating negative pressure (e.g., 0.5 to 0.7 cc).

As a result, when the interior of the head tank 35 is released to the atmosphere in a state in which the amount of ink is smaller than the normal filling ink-full state by 1.567 to 1.767 cc (1.567=2.267−0.7; 1.767=2.267−0.5), the liquid level just contacts the supply port 209*a* of the supply port member 209.

Since the liquid consumption amount count V is counted on liquid discharging, such as droplet ejection and maintenance suction, variations of the liquid consumption amount count V are taken into account. Here, such variations are assumed to be within a range of +/−4.0%.

When the threshold value Y cc is set as the condition in which the liquid level reliably contacts the supply port 209*a* of the supply port member 209, the threshold value Y can be set to 1.119 cc (approximately 1.567/1.4) or lower.

When the threshold value Z cc is set as the condition in which the liquid level is reliably away from the supply port 209*a* of the supply port member 209, the threshold value Y can be set to 2.473 cc (approximately 1.767×1.4) or greater.

Next, a third exemplary embodiment of this disclosure is described below.

As described above, since the liquid consumption amount is measured by soft counting, the liquid consumption amount count V might significantly deviate from an actual consumption amount.

In particular, when the image forming apparatus is left unused for a long period, moisture in the head tank 35 might evaporate due to the permeability of the tank case 201 and the film member 203 of the head tank 35, thus resulting in a considerable reduction in the actual amount of ink in the head tank 35. In such a case, when a supply time out occurs in a subsequent ink filling operation, air might be inhaled to the supply passage 36 by reverse rotation feeding. Hence, in such a case, the controller 500 in this exemplary embodiment does not perform reverse rotation feeding.

Alternatively, if a large amount of ink leaks from nozzles during standby of the image forming apparatus, the liquid consumption amount count V would significantly deviate from an actual consumption amount of ink in the head tank 35. For example, if the detection state of the electrode pins 208 shifts from a state of detecting the liquid level to a state of detection air in a short time during standby of the image forming apparatus, it is assumed that a large amount of ink has leaked and the actual consumption amount of ink has significantly decreased.

In such a case, when a supply time out occurs in a subsequent ink filling operation, air might be inhaled to the supply passage 36 by reverse rotation feeding. Hence, in such a case, the controller 500 in this exemplary embodiment does not perform reverse rotation feeding.

For example, the RTC 520 can be used to determine whether the image forming apparatus has been left unused for a threshold time period or whether the image forming apparatus is on standby.

The controller 500 determines whether a large amount of ink leaks during standby of the image forming apparatus as follow. First, the controller 500 stores a time (time 1) at the end of air release filling. During standby of the image forming apparatus, the controller 500 detects the electrode pins 208 on regular basis and stores a time (time 2) when the detection state of the electrode pins 208 changes from the liquid-level detection state to the air detection state. If the time difference obtained by subtracting the time 1 from the time 2 is a threshold time or less, it is assumed that air has rapidly leaked into the head tank 35 to leak a large amount of ink from nozzles. Hence, the controller 500 determines that a large amount of ink has leaked.

Numerous additional modifications and variations are possible in light of the above teachings. It is therefore to be understood that, within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus comprising:

a recording head to eject droplets of a liquid;

a head tank mounted on the recording head to supply the liquid to the recording head;

a main tank removably mounted in the image forming apparatus to store the liquid to be supplied to the recording head;

a liquid supply passage connecting the main tank to the head tank to supply the liquid from the main tank to the head tank;

a liquid feed device to feed the liquid from the main tank to the head tank and in reverse from the head tank to the main tank;

a measurement unit to measure a consumption amount of the liquid discharged from the recording head; and a supply controller to drive the liquid feed device to control a liquid supply operation on the head tank, wherein the head tank includes a tank housing, a liquid storage portion disposed in the tank housing to store the liquid, a liquid level detection member to detect a liquid level of the liquid in the liquid storage portion, a liquid supply port member connected to the liquid feed device via the liquid supply passage, the liquid supply port member having an opening at a position lower than the liquid level detection member in the liquid storage portion, and an air release unit to open and close an interior of the liquid storage portion relative to an atmosphere, and wherein, when the liquid feed device feeds the liquid from the main tank to the head tank with the interior of the liquid storage portion opened relative to the atmosphere by the air release unit and the liquid level detection member does not detect the liquid level of the liquid after an elapse of a threshold time, the supply controller controls the air release unit to close the interior of the liquid storage portion relative to the atmosphere and determines whether or not a measurement value of the consumption amount of the liquid measured by the measurement unit is a first threshold value or lower, and when the measurement value is the first threshold value or lower, the supply controller performs a reverse feed control to drive the liquid feed device to feed the liquid in reverse from the head tank to the main tank.

2. The image forming apparatus of claim 1, wherein, after the air release unit closes the interior of the liquid storage portion relative to the atmosphere, the measurement unit does not measure at least a portion of the consumption amount of the liquid discharged from the recording head.

3. The image forming apparatus of claim 1, wherein the supply controller determines whether or not the measurement value of the consumption amount of the liquid measured by the measurement unit is a second threshold value or greater, and when the measurement value is the second threshold value or greater, the supply controller performs the reverse feed control to drive the liquid feed device to feed the liquid in reverse from the head tank to the main tank.

4. The image forming apparatus of claim 1, wherein, when the liquid supply operation is performed for a first time after an elapse of a threshold unused period of the image forming apparatus and the liquid level detection member does not detect the liquid level of the liquid after an elapse of the threshold time in the liquid supply operation, the supply controller does not perform the reverse feed control when the measurement value is the first threshold value or lower.

5. The image forming apparatus of claim 1, wherein, when the liquid supply operation is performed for a first time after detection of an air intrusion in the head tank during a standby of the image forming apparatus and the liquid level detection member does not detect the liquid level of the liquid after an elapse of the threshold time in the liquid supply operation, the supply controller does not perform the reverse feed control when the measurement value is the first threshold value or lower.

* * * * *